356-153 SR
1/30/79 OR 4,136,956

United States Patent [19]
Eichweber

[11] 4,136,956
[45] Jan. 30, 1979

[54] INTEGRATED ATTACHING AND ALIGNING APPARATUS FOR LASER DEVICES IN GUN BARRELS

[76] Inventor: Kurt Eichweber, Schutzenstrasse 77-85, 2000 Hamburg 50, Germany

[21] Appl. No.: 779,953

[22] Filed: Mar. 21, 1977

[30] Foreign Application Priority Data

Mar. 31, 1976 [DE] Fed. Rep. of Germany ..... 2613821

[51] Int. Cl.[2] ..... F41G 3/26; F41F 27/00

[52] U.S. Cl. ..... 356/153; 350/11; 362/111

[58] Field of Search ..... 356/138, 153–154, 356/120, 122–123, 241; 350/11; 33/234, DIG. 21; 285/397; 403/227, 372; 362/10–14, 259, 372, 111

[56] References Cited

U.S. PATENT DOCUMENTS

| | | | |
|---|---|---|---|
| 2,145,277 | 1/1939 | Reardon | 362/111 |
| 2,367,088 | 1/1945 | Benson | 403/227 |
| 3,222,096 | 12/1965 | Kaman | 403/372 |
| 3,526,972 | 9/1970 | Sumpf | 362/111 |
| 4,048,489 | 9/1977 | Giannetti | 362/259 |

FOREIGN PATENT DOCUMENTS

| | | | |
|---|---|---|---|
| 893039 | 4/1962 | United Kingdom | 403/372 |

*Primary Examiner*—John K. Corbin
*Assistant Examiner*—Wm. H. Punter
*Attorney, Agent, or Firm*—Cushman, Darby & Cushman

[57] ABSTRACT

An integrated attaching and aligning apparatus for mounting a laser shot simulator or the like in gun barrels of different calibers with a barrel member of two coaxial sections which slides into the gun barrel. A first resilient ring is removably mounted about the first section at one end for engaging and centering the barrel member in the gun barrel. A second resilient ring is removably mounted on an inside barrel between the two sections at the other end of the barrel member so that axial force applied to the second ring by the second section deforms the second ring against the gun barrel to center the barrel member in the other end. A laser source receiver and lens are adjustably mounted within the barrel member.

11 Claims, 7 Drawing Figures

INTEGRATED ATTACHING AND ALIGNING APPARATUS FOR LASER DEVICES IN GUN BARRELS

The invention relates to an integrated attaching and aligning apparatus for mounting a laser device in a gun barrel, especially laser shot simulators with laser tubes guided coaxially one in the other, which are mutually shiftable axially by means of togglelike tensioning devices and press a ring of preferably elastically resilient material, filling the volume outwardly against the inside surface of the bore of the gun barrel.

A laser shot simulator or laser transmitting device must be aligned either parallel to the line of sight or coaxially with it. A proposal has been made to accommodate the laser transmitting device in the gun barrel in order to align the line of sight with the axis of the bore of the gun barrel. If the device is in perfect condition and perfectly mounted, a special checker of the line of sight is unnecessary.

It has also been known to mount a laser transmitting device or laser shot simulator firmly on the weapon outside the axis of the barrel bore. In this case, special alignment is required, but an externally mounted device is considered a universal device usable for different calibers. However, the advantages of universality are offset by the difficulty of establishing an additional adjustment axis, namely that of the laser transmitter in the distant field. This adjustment axis is unnecessary when the laser transmitting device is mounted in the gun barrel, insofar as the adjustment of the laser beam concentrically in relation to the optical axis of the laser transmitting device has already been accomplished during production.

The attachment of the laser transmitting device is accomplished close to the muzzle. In this section of the barrel, checkers for the lines of sight are also customarily mounted in order to determine the precision of the position of the axis of the bore of the barrel in respect to the line of sight and to realign the latter as necessary.

Various highly precise concentrically acting chucks are conceivable. In particular, it has been known to coaxially deform a concentric ring made of an elastic material, e.g., rubber or polyurethane, neoprene, etc., by axial pressure so that the elastic material is pressed in the direction of the only remaining degree of freedom, namely against the wall of the gun barrel. In doing so, a firm seat in the gun barrel results from the radial pressure.

The disadvantages of this approach result from the screwing required to apply the axial pressure and the wear and tear caused by friction. The conversion of the required forces for the extrusion of the elastic substance stipulates a high transmission, a gearing and finally a special apparatus with which this chucking process is accomplished. For every gun caliber, a special chucking arrangement and sizing of the laser transmitting device is necessary. The forces needed for the screwing together will not permit the construction of light chucking arrangements. The problem remains that each device must be for a specific caliber construction which precludes universal use over a broad range of calibers.

The object of the present invention is a device which can be easily, precisely and securely mounted as an integrated attaching and aligning apparatus for laser devices at minimum cost. The present invention may be coaxially attached precisely with few manipulations in gun barrels of variable caliber, and permits the use of a single laser transmitting device or of a laser transmitting and receiving device for the purpose of measuring distances over and beyond a broad spectrum of calibers. Further, the divergence of the laser within the framework of the alignment is also adjustable.

This object is accomplished according to the present invention in that variable annular chucking arrangemnets adapted to different diameters are available and may be inserted interchangeably into the chucking arrangements, whereby the chucking elements may be operated via the toggles of the chucking arrangement by means of a handlelike clamping and carrying stirrup. Variable annular clamping elements adapted to different caliber diameters are mounted interchangeably at a distance of at least more than two caliber diameters, preferably on a housing ring. The housing ring may be rotated and locked against the inside barrel of the attaching and aligning apparatus in order to thus align the laser source axially against an objective supported in the attaching and aligning apparatus.

An attaching and aligning apparatus constructed in accordance with the invention makes the coaxial aligning of laser transmitting devices and laser receiving devices simply and highly precisely to the axis of the bore of the gun barrel, whereby the laser transmitting device and possibly the laser receiving device may also be aligned in addition axially within the gun barrel for the adjustment of the divergence of the laser.

This adjustment of the divergence of the laser beam makes possible advantageous scattering of the laser transmitting device for the purpose of the simulation of the shot to the weapon that is to be simulated, by indeed adjusting the divergence of the laser beam to a desired measure. The adjustability of the laser beam divergence in certain predetermined values, however, is also particularly advantageous in regard to the purpose of its use. If indeed, a shot simulator is to be used for purposes of marksmanship training, e.g., of opto-electric sensors on practice targets, then a laser beam of the lowest possible divergence is preferred. In the case of use against large surface targets, e.g., against ships or vehicles, then the number of opto-electrical sensors should be kept within bounds, and e.g., prefer the upper limit of the natural sector of the weapon as a value of the laser beam divergence. This possibility is offered by the attaching and aligning apparatus according to the invention in an advantageous manner. Equal flexibility is possible with respect to the adjustability of the laser beam lobe with reference to the distance of the target and the condition for expansion of the radiation in the atmosphere. Thus, in combat training and in maneuvers, a greater beam divergence than in the case of the prescribed basic training, e.g., in a training shooting range near the garrison will become necessary.

According to a further aspect of the invention, the housing ring which adjusts the divergence of the laser beam may be lockable with a counter nut in its position toward the outside barrel. The adjustment of divergence is accomplished advantageously so that the laser transmitter with the housing ring is shiftable against a compression spring via a barrel-shaped support guided coaxially in the outside barrel, which is supported by the support for the objective. Similarly, in the tube-shaped support, a laser receiving device may also be disposed which, together with the laser transmitter and a radiation divider, is shiftable axially together with the tube-shaped support.

According to a further aspect of the invention, provision has been made for highly precise coaxial alignment of the laser transmitter and, if desired, the laser receiver. The chucking elements have a pressure sleeve with at least one surrounding ring-like bead, and the pressure sleeve preferably is somewhat larger than the pertinent caliber dimension. This pressure sleeve consists of a tough-elastic material preferably with inserts of fabric, which in the case of pushing of the attaching and aligning apparatus into the gun barrel, will yield slightly.

In order to encourage the deformation of volume which results as the device is pushed into the gun barrel, provision has furthermore been made that the annular clamping element on the reverse side of the pressure sleeve will have a recess of approximately the volume of the annular bead. In this case, several annular beads may also be provided and correspondingly several bead-like recesses in the clamping element.

For adaptation of the clamping elements to variable caliber measurements, the clamping elements preferably consist of two rings with flangelike edges which can be telescoped into one another and between which the elastic, resilient material ring is inserted. Instead of the elastic, resilient material, a package of plastic-coated spring plates (lock washers) can be used. The clamping elements can also be a spiral spring or a metal ring expanded by a system of cones.

The advantages and characteristics of the invention are also apparent from the following description of embodiments given by way of example in connection with the claims and the drawings in which:

Figure 1:
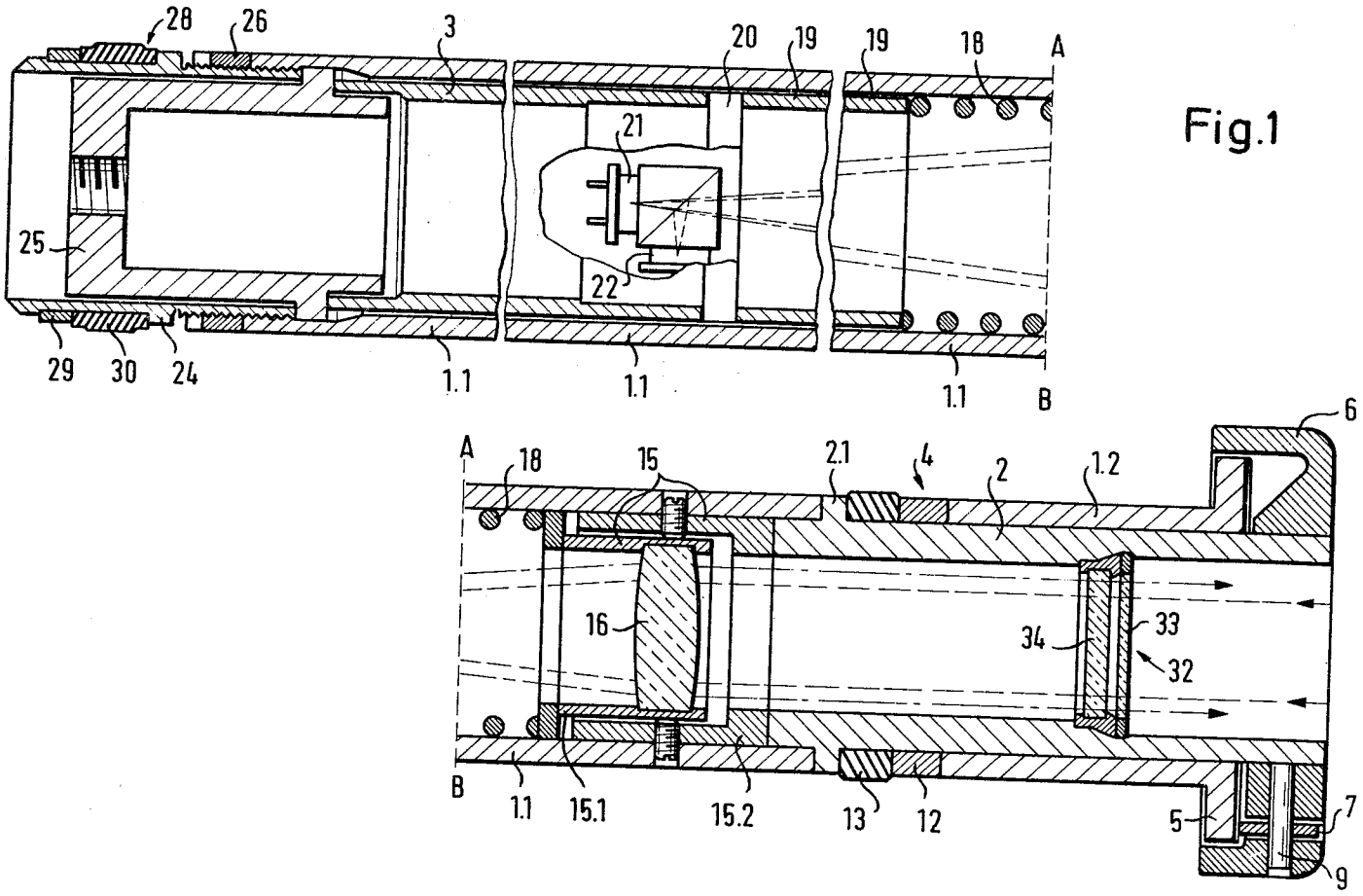
FIG. 1 shows a longitudinal section through an integrated attaching and aligning arrangement according to the invention with a built-in laser transmitting device and a laser receiving device.
Figure 2:
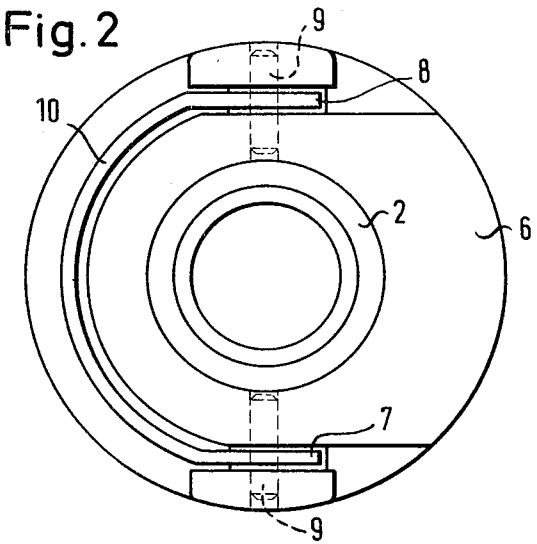
FIG. 2 shows a front view of the attaching and aligning arrangement.
Figure 7:
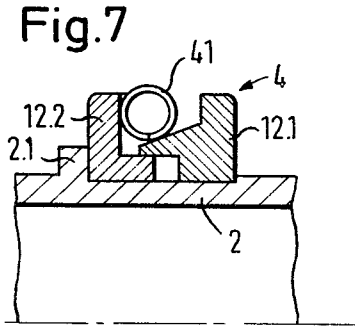
FIG. 7 shows a partial section through yet another embodiment of an interchangeable clamping element.

The integrated attaching and aligning arrangement shown in FIG. 1 is provided for a laser transmitting device and a laser receiving device in gun barrels of variable caliber dimensions and is coordinated in its dimensioning with the smallest caliber side, e.g., 35, 38, 40, 75, etc. The arrangement of FIG. 1 fits within a conventional gun barrel as discussed below. The attaching and aligning arrangement comprises an outside barrel which is sub-divided into barrel sections 1.1 and 1.2. In barrel section 1.1, the laser transmitting device and the laser receiving device with the pertinent electronics is accommodated in a pipe-shaped mounting 3 guided coaxially in an outside tube or barrel. An inside barrel ring 2 is mounted on the front end of barrel section 1.1. Barrel 2 has a shoulder 2.1 which abuts against the front end of barrel section 1.1. On the front end of inside barrel 2, the front barrel section 1.2 of the outside barrel has been pushed on with interposition of a clamping element 4. This front barrel section 1.2 of the outside barrel is provided with a stop 5, which upon pushing the attaching and aligning apparatus into a gun barrel, comes to a stop at the front surface of the muzzle of the gun barrel. The inside barrel 2 carries a clamping flange 6 on the part projecting forward beyond the stop 5, in which the toggles 7 and 8 of the clamping arrangement have been mounted rotatably with pegs 9. These two toggles are interconnected by means of a handle-like clamping and carrying stirrup 10 (FIG. 2). To position the clamping and carrying stirrup 10 shown in FIGS. 1 and 2, the barrel section 1.2 of the outside barrel is shifted against the clamping element 4, whereby the shiftable ring 12 is pressed against an elastically resilient material ring 13 so that the latter protrudes beyond the surface of the outside barrel. At the same time this ring 13 fits against the inside surface of the bore of the gun barrel (not shown) and presses the attaching and aligning apparatus in coaxial position in relation to the axis of the gun bore.

At the front end of the barrel section 1.1 in the outside barrel, a support 15 for the lens has been disposed with which a lens 16 is held axially shiftable in the outside barrel. The lens support consists of two barrel sections of which the barrel section 15.1 is axially shiftable in the barrel section 15.2. Since the barrel section 15.1 carries the lens 16, the lens is also thus mounted to be axially shiftable. A compression spring 18 fits against the barrel section 15.1 of the lens mounting, which may be tightened by way of an intermediate casing 19. Between the pipe-shaped mounting 3 and the intermediate casing 19, there is a collar of a ray guide 20 in which the laser transmitting device 21 and the laser receiving device 22 have also been housed. The pipe-shaped mounting 3 which receives the electronic system for the laser transmitting device and the laser receiving device continues up into the area of the rear end of the barrel section 1.1 of the outside barrel. This rear end of the outside barrel has been provided with an inside thread into which a positioning ring 24 may be screwed which acts on a connecting part 25 and by way of part 25, as well as the pipe-shaped mounting 3, the collar of the ray guide 20 and the intermediate casing 19 acts on the compression spring 18, so that the pipe-shaped mounting 3 may be axially adjusted inside of the outside barrel by shifting positioning ring 24. After this axial adjustment, which adjusts the divergence of the laser beam, positioning ring 24 is fixed at the rear end of the outside barrel by way of a counter nut 26.

Furthermore, a clamping element 28 is arranged on positioning ring 24, which consists of a ring 29 and a pressure cuff 30. Clamping element 28 can be exchanged for another clamping or tensioning element corresponding to another caliber dimension, as can tensioning element 4.

At the front end of the attaching and aligning arrangement, inside of the inner barrel 2, a closing optical system 32 has been provided which comprises a covering glass 33 and a system of lenses 34. The purpose of the covering glass 33 is to close the inside of the attaching and aligning arrangement hermetically against the outside space, whereas the system of lenses 34, serves for forming the radiation lobe.

The laser beam produced in the laser transmitting device 21 is converted into parallel rays in lens 16 and emerges as such from the front side of the attaching and aligning arrangement. This bundle of rays has been indicated in a dash dot line with its marginal rays. The received laser beam which has been indicated in a broken line is deflected along a reflection surface in the ray guide 20 in the direction toward the laser receiving device 22.

The attaching and aligning arrangement pushed into the gun barrel from the front is attached in the gun barrel by the reversal of the clamping and carrying stirrup 10 into the position which is illustrated in FIG. 2. At the same time the toggles press against a compression plate located on stop 5. Thus, the stop 5 and the barrel section 1.2 of the outside barrel are pressed against attaching ring 12 which on its part escapes and deforms the elastic material ring 13 uniformly radially and at the same time presses against the inside wall of the gun barrel, as a result of which a firm seat of the attaching and aligning arrangement in the bore of the barrel is guaranteed for the duration of the mounting, in connection with the guidance conditional on the clamping element 28.

Figure 4:
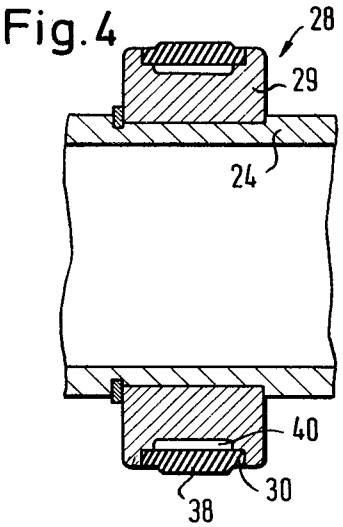
FIG. 4 shows a partial section through another interchangeable clamping element.
Figure 3:
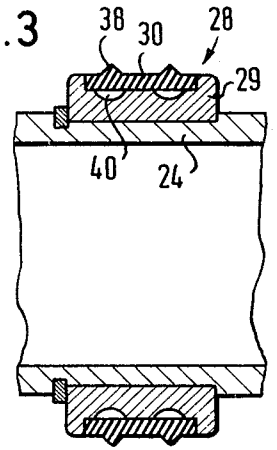
FIG. 3 shows a partial section through one of the interchangeable clamping elements.

The tensioning elements 4 and the clamping elements 28 kept available for variable caliber dimensions, may be exchanged by a few simple manipulations. In FIGS. 3 and 4, clamping elements for other caliber dimensions have been shown which consist of an attaching ring 29 and a pressure cuff 30. The pressure cuff has been produced from a tough-elastic material into which preferably layers of fabric are inserted. The outside diameter of the pressure cuff is preferably slightly smaller than the pertinent caliber dimension and is provided with at least one bead 38 according to FIG. 4 or preferably two beads 38 according to FIG. 3.

In order to ensure equalization of the volume in the case of deforming of the pressure cuff, one or more recesses 40 are provided in the surface of the groove of the attaching ring 29 receiving the pressure cuff, into which recesses a pressure cuff can escape during jamming into the bore of the barrel.

Figure 5:
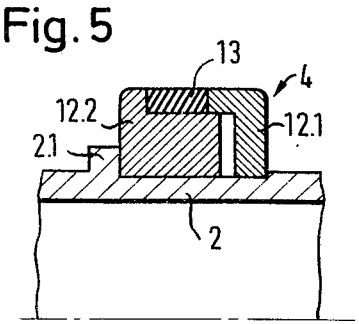
FIG. 5 shows a partial section thourgh an interchangeable clamping element.

In FIG. 5, an embodiment of a tensioning element is shown, in which the attaching ring consists of two parts 12.1 and 12.2. The two parts are provided with flange-like edges between which the resilient material ring 13 is inserted. Upon jamming, the flange of the part 12.1 pushes over the core of the part 12.2 of the attaching ring, as a result of which the material ring 13 is deformed as to its volume and protrudes to the outside beyond the outside surface.

The tensioning element causing the firm seat of the attaching and aligning arrangement in the gun barrel, may also have slitted metal rings spread apart by a cone system according to choice instead of the material ring 13 (not shown).

Figure 6:
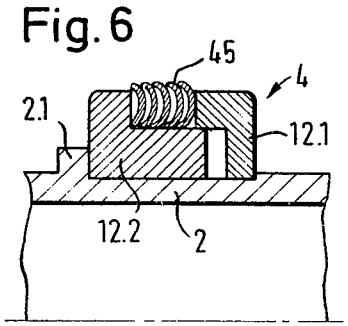
FIG. 6 shows a partial section through a further embodiment of an interchangeable clamping element.

In FIG. 6, an embodiment of the tensioning element 4 has been shown in which annular spring plates (lock washers) coated with plastic are inserted between the two parts 12.1 and 12.2 of the attaching ring. Upon jamming, the curvature of the spring plates is flattened, so that the outside edge is shifted coaxially to the outside and fits against the inside wall of the bore of the barrel.

Instead of the spring plates according to FIG. 6, an endless spiral spring 41 may also be used, which is pressed with the help of a conically raised surface of the part 12.1 of the attaching ring uniformly to the outside against the inside surface of the bore of the gun barrel.

Although basically all described forms of the tensioning elements make possible a perfect tensioning of the attaching and aligning arrangement in the gun barrel, preference is given to elastic materials.

Another embodiment of the invention (not shown) provides for the purposes of shot simulation and of the line of sight examination that the attaching and aligning arrangement be provided with an additional tensioning element, which is disposed at least at a distance of two caliber diameters from the first tensioning element. This tensioning element may be pressed in connection with the two toggles connected by the clamping and carrying stirrup via an additional, intermediate casing simultaneously with the first tensioning element against the inside wall of the bore of the gun barrel and thus may be fixated radially in relation to the radial attachment of the shot simulator or of the line of sight examiner. In the case of the described embodiment, the clamping element attached at the rear end of the positioning ring is used instead of the second tensioning element. At the same time, the pressure cuff brings about an automatic centering as a result of the fact that the cuff has an almost equal diameter as the assigned measurement of caliber and is provided with at least one encircling, annular bead. This bead has a slight excess tolerance and, as has already been explained, is pressed against the recess 40 or grooves of the attaching ring 29 made of metal. As a result of that a seat resisting shocks and free of vibrations will be obtained which, within the scope of inside tolerance leads possible within the manufacturing techniques, causes a precise alignment of the optical axis of the device in relation to the axis of the bore of the gun barrel.

Just above, the embodiment of an attaching and aligning arrangement for a perfect coaxial attachment and automatic alignment of a laser transmitting device or of a laser receiving device in relation to the axis of the bore of the gun barrel has been described, whereby, as an additionally required adjustment, the adjustment respectively the adaptation of the laser beam divergence to the variable needs of variable types of guns and dispersion areas of the munition is made possible by shifting the individual laser elements as against a lens axially inside of the attaching and aligning arrangement. These actual laser elements are disposed in the form of a construction module in the pipe-shaped mounting 3 which is conceived such that the distance of the laser transmitting device or of the laser receiving device in relation to the preadjusted lens fixed in the protective barrel, is adjustable against the pressure of a helical spring in an alternating direction by means of the positioning ring. This positioning ring, as has already been mentioned, has a single or multiple thread, a corresponding index scale preferably with marker which for the user makes possible an adjustment independently of the operation of the divergence of the laser beam without any other aligning means.

What is claimed is:

1. An integrated attaching and aligning apparatus for mounting a laser shot simulator in gun barrels of different calibers, comprising:

a hollow, cylindrical barrel member for being received within said gun barrel, said barrel member being formed in first and second coaxial sections;

means mounted within said barrel member for producing a laser beam simulating a shot from the gun barrel;

a first annular resilient ring being removably disposed about said one section of said barrel member adjacent one end thereof for engaging the interior of said gun barrel and centering said barrel member in said one end of said gun barrel;

a barrel ring;

a positioning ring removably attached coaxially to said barrel member at one end thereof for mounting said first resilient ring member.

a second annular resilient ring member disposed on the exterior surface of said barrel ring between said sections for engaging a gun barrel interior surface of a given caliber;

means for applying an axial force to said second section to deform said second ring member outward to engage and center said barrel member in said other end of said gun barrel.

2. An apparatus as in claim 1, wherein said barrel ring includes an inside barrel fitting into said second section of said barrel member and having a stop at one end engaging the end of said first section on one side and said second annular ring member of the other side and said second section having a second stop at the other end for engaging on one side the end of the gun barrel, and said force applying means including a clamping flange engaging the other side of said second stop, and toggles for applying an axial force to said flange, through said flange to said second section and through said second section to said second ring member.

3. An apparatus as in claim 1, wherein said producing means includes a casing slidable within said barrel member, and a source of laser beams within said casing, means for receiving light reflected from an object and wherein said apparatus further includes a lens for rendering light from said source parallel, means for mounting said lens for slidable movement within said barrel member and spring means engaging said lens mounting means and casing for urging said lens mounting means and casing apart.

4. An apparatus as in claim 3, wherein said positioning ring is threadably coupled to said one section of said barrel member and including a lock nut for axially moving said casing to change the distance between said casing and said lens mounting member.

5. An apparatus as in claim 1, wherein said first annular ring member includes an annular pressure cuff having at least one encircling bead on the exterior surface thereof.

6. An apparatus as in claim 5, wherein said cuff is comprised of elastic material with inserts of fabric.

7. An apparatus as in claim 5, further including a barrel shaped clamping element between said pressure cuff and said positioning ring and said clamping element has a recess on the side adjacent said cuff approximately equal to the volume of said bead.

8. An apparatus as in claim 7, wherein said cuff has a plurality of beads and said clamping element, a plurality of recesses.

9. An apparatus as in claim 7, wherein said force applying means includes a pair of attaching rings having flanges for engaging said second ring member.

10. An apparatus as in claim 9, wherein said second ring member includes a plurality of plastic coated spring plates.

11. Apparatus as in claim 9, wherein said second ring member is a spreadable spiral spring.

* * * * *